US005490766A

United States Patent [19]

Zeck

[11] Patent Number: 5,490,766

[45] Date of Patent: Feb. 13, 1996

[54] PRECISION SMALL DISPLACEMENT FLUID PUMP

[75] Inventor: Mark V. Zeck, Hermleigh, Tex.

[73] Assignee: Y-Z Industries Sales, Inc., Snyder, Tex.

[21] Appl. No.: 394,288

[22] Filed: Feb. 24, 1995

[51] Int. Cl.[6] ..... F04B 21/00; F04B 35/02

[52] U.S. Cl. ..... 417/63; 417/379; 417/401; 137/101.11; 137/101.21; 137/101.31; 73/46; 73/168; 92/86.5; 92/153

[58] Field of Search ..... 417/63, 379, 401, 417/569, 570, 571; 137/101.11, 101.21, 101.31; 92/153, 86.5, 13.8; 73/46, 168; 277/2

[56] References Cited

U.S. PATENT DOCUMENTS

| | | | |
|---|---|---|---|
| 4,180,083 | 12/1979 | Miyaoka et al. | 137/101.25 |
| 4,436,674 | 3/1984 | McMenamin | 261/64 B |
| 4,531,895 | 7/1985 | Zeck | 417/570 |
| 4,611,294 | 9/1986 | Stanfill | 364/173 |
| 5,032,063 | 7/1991 | Zeck et al. | 417/383 |
| 5,152,678 | 10/1992 | Zeck | 417/570 |
| 5,193,991 | 3/1993 | Koelder et al. | 417/571 |
| 5,213,586 | 5/1993 | Welker | 417/401 |
| 5,252,042 | 10/1993 | Yonezawa | 417/401 |
| 5,345,812 | 9/1994 | Haboian | 73/46 |
| 5,372,352 | 12/1994 | Smith et al. | 73/46 |

FOREIGN PATENT DOCUMENTS

| | | | |
|---|---|---|---|
| 415008 | 8/1934 | United Kingdom | 92/153 |
| WO95/00892 | 1/1995 | WIPO . | |

*Primary Examiner*—Charles Freay
*Attorney, Agent, or Firm*—Vinson & Elkins

[57] ABSTRACT

A fluid pump for displacing a small, precise volume of fluid for each pump stroke, particularly where the fluid to be displaced is a liquid containing dissolved gas. The precise volume of fluid to be displaced is adjustable to any selected amount up to the full displacement of the pump. The pump has instrumentation that indicates a seal failure within the pump, thus allowing for maintenance on the pump before a total failure. This instrumentation results in increased safety when the pump is used to inject odorant into a natural gas pipeline or in other precision chemical injection applications.

14 Claims, 4 Drawing Sheets

5

120
FROM PNEUMATIC SOURCE 212
10
20
50
140
30
110
90
FROM ODORANT RESERVOIR 204
TO NATURAL GAS PIPELINE 202
70

5

FROM PNEUMATIC SOURCE 212
120
10
20
50
30
140
90
110
FROM ODORANT RESERVOIR 204
TO NATURAL GAS PIPELINE 202
70

PRECISION SMALL DISPLACEMENT FLUID PUMP

This invention relates generally to fluid pumps and more particularly to a fluid pump for displacing a small, precise amount of fluid where the fluid displaced is a liquid containing dissolved gas.

BACKGROUND OF THE INVENTION

Because natural gas is colorless and odorless, many techniques to odorize, or inject a liquid perfume into, a natural gas supply have been developed in an effort to increase the safety of this valuable energy source for the millions of consumers who use it. For every natural gas pipeline, a precise volume of odorant must be injected into the pipeline so that gas leaks are detectable. The volume of odorant required to properly odorize a pipeline depends on the flow rate and composition of the natural gas within the pipeline.

Proper odorization of natural gas is equally important in both high and low volume applications, but the present invention is particularly beneficial for proper odorization in small diameter pipeline, low volume applications having flow rates ranging from 0.5 mcf/hr to 2 mmcf/hr. In the natural gas distribution industry, a large diameter pipeline typically delivers natural gas from the field to a local distribution center. These large diameter pipelines generally have flow rates ranging from 1 mmcf/hr to 50 mmcf/hr. The local distribution center removes gas from the large diameter pipeline and then delivers gas to the homes and businesses located in a given community. The local distribution center removes gas from the large pipeline at multiple locations, and the center must odorize the gas removed at each location. Each one of these locations typically uses a variety of small diameter pipelines, depending on the size of the community being served and thus the volume of gas required. Small diameter pipelines are also utilized in field applications, and therefore the present invention is beneficial for use in this environment as well.

Several static techniques, that is, techniques which generally utilize no moving parts, have been developed for odorization in low volume applications. One such technique is commonly referred to as a wick odorizer. In a wick odorizer, an odorant reservoir is directly connected to a small diameter natural gas pipeline. The reservoir is partially filled with liquid odorant, and a wick is suspended with one end in contact with the odorant and the other end extending into the pipeline. The wick draws odorant from its reservoir end into the pipeline via capillary action, and the liquid odorant evaporates into the flowing gas of the pipeline from the pipeline end of the wick.

Another example of an existing static technique is a bypass odorizer. In a bypass odorizer, a constriction is formed in a small diameter pipeline, and a fluid bypass conduit is routed to exit the pipeline on the upstream side of the constriction and re-enter the pipeline on the downstream side of the constriction. An odorant reservoir that is partially filled with liquid odorant is connected to the bypass conduit between the point where the conduit exits the pipeline and the point where the conduit re-enters the pipeline. The constriction creates a pressure drop in the pipeline that causes some of the gas within the pipeline to flow through the bypass conduit and over the liquid odorant in the reservoir. The liquid odorant evaporates into the natural gas flowing through the bypass conduit, and the odorized natural gas then re-enters the pipeline. The bypass conduit can be equipped with valves to adjust the volume of odorant provided to the pipeline in response to downstream monitoring of odorant levels in the pipeline.

Unfortunately, these static techniques exhibit several problems. First, the volume of odorant injected into a pipeline is imprecise and is often unpredictable. Second, in a bypass odorizer, particulates fall out of the natural gas flowing above the liquid odorant in the reservoir and coat the surface of the liquid odorant in the reservoir, thus decreasing the evaporation of the odorant into the gas. Third, if an accident occurs, a natural gas distributor must be able to prove proper odorization at the exact time and location of the accident, and such proof is particularly difficult given the unpredictability of these static methods.

In large diameter pipelines, large displacement liquid pumps have been utilized to inject precise volumes of liquid odorant into such pipelines with more predictable results. Such large displacement pumps typically inject 0.2 cc to 6 cc of odorant per stroke of the pump. Such pumps are typically operated by a control system which monitors the flow rate in the pipeline and determines a corresponding stroke rate for the pump necessary to inject the proper amount of odorant into the pipeline. U.S. patent application Ser. No. 08/083,135, now issued as U.S. Pat. No. 5,406,970 on Apr. 18, 1995, and which is commonly assigned with the present invention and discloses an example of such a control system, is incorporated herein by reference.

Existing liquid odorant injection pumps, particularly such pumps having a small displacement in the range of 0.02 cc to 0.1 cc per stroke, suffer from an additional problem. For a variety of reasons which are later discussed in more detail, the odorant supplied to odorant injection pumps is often a liquid containing dissolved gas. This dissolved gas often prohibits the pumping of a precise volume of fluid per stroke, as is explained below.

Since gas is compressible and liquid is generally incompressible, each stroke of a pump compresses any dissolved gas before it is displaced. Whether the dissolved gas is displaced, instead of merely being compressed, depends on the volumetric efficiency of a given pump. For the purposes of this invention, volumetric efficiency is defined as the volume of fluid displaced from a pump chamber for each pump stroke divided by the total volume of the pump chamber at the full upstroke position of the pump. If a pump has a high enough volumetric efficiency, it will displace most, if not all, of the dissolved gas for each pump stroke.

Existing liquid odorant injection pumps do not have a high enough volumetric efficiency to displace all or substantially all of the dissolved gas within their pump chambers for each pump stroke. Therefore, the presence of dissolved gas prevents existing liquid odorant injection pumps from reliably displacing a precise volume of odorant per stroke. In addition, if this non-displaced gas accumulates during operation, the pump can become "vapor locked," meaning the pump is generally compressing gas instead of displacing liquid. Large displacement pumps often eventually work through a vapor lock condition by progressively displacing the accumulated non-displaced gas. However, existing small displacement pumps, such as those displacing 0.02 cc to 0.1 cc per stroke, exhibit significantly more vapor locking problems.

Pure gas pumps having a displacement of 0.02 cc to 0.1 cc per stroke have been developed. However, such pure gas pumps cannot reliably pump a liquid containing dissolved gas. Although such gas pumps typically have a very high volumetric efficiency, the orifices, chambers, and seals of these pumps are designed to displace gas, which has a larger molecular spacing than liquid. If such a gas pump is utilized to pump a liquid containing dissolved gas, the pump seals and valves tend to fail after an unacceptably short time of service.

Therefore, a critical need exists for an odorant injection pump with a displacement in the range of 0.02 cc to 0.1 cc of odorant per stroke that is capable of reliably pumping a precise volume of liquid odorant containing dissolved gas. Such a fluid pump is necessary for the proper odorization of small diameter natural gas pipelines, and such a pump may prove beneficial in other applications which require a small, precision volume of fluid or chemical injection.

It is therefore an object of the present invention to provide a fluid pump for displacing a precise volume of a liquid containing dissolved gas.

It is a further object of the present invention to provide such a pump that displaces 0.02 cc to 0.1 cc for each pump stroke.

It is a further object of the present invention to provide such a pump in which the precise volume of fluid displaced can be adjusted to a selected amount in the range of 0.02 cc to 0.1 cc for each pump stroke.

It is a further object of the present invention to provide such a pump that includes instrumentation for indicating a decrease in the volumetric efficiency of the pump chamber due to a pump seal failure.

It is a further object of the present invention to provide such a pump that has modular components that are easily removable for service, testing, or replacement.

It is a further object of the present invention to provide such a pump for injecting a liquid odorant containing dissolved gas into a small diameter natural gas pipeline.

It is a further object of the present invention to provide such a pump for injecting a liquid odorant containing dissolved gas into a small diameter natural gas pipeline that prevents odorant leakage into the environment due to a pump seal failure.

Still other objects and advantages of the present invention will become apparent to those of ordinary skill in the art having references to the following specification together with its drawings.

SUMMARY OF THE INVENTION

The present invention is directed to a fluid pump for displacing a precise volume of fluid for each pump stroke, particularly where the fluid to be displaced is a liquid containing dissolved gas. In the preferred embodiment, the present invention includes a housing having a pump chamber inside the housing. The pump chamber has an inlet and an inlet check valve that allow fluid to flow into the pump chamber but not out of the pump chamber. The pump chamber has an outlet and an outlet check valve that allow fluid to flow out of the pump chamber but not into the pump chamber. The pump chamber also has a volumetric efficiency sufficient to displace gas.

The pump also includes a reciprocating means within the pump chamber. The reciprocating means is moved back and forth to displace a precise volume of the liquid, including the gas dissolved within the liquid, from the pump chamber through the outlet for each pump stroke.

BRIEF DESCRIPTION OF THE INVENTION

For a more complete understanding of the present invention, and the advantages thereof, reference is now made to the following descriptions taken in conjunction with the accompanying drawings, in which.

DETAILED DESCRIPTION OF THE PREFERRED EMBODIMENT

The preferred embodiment of the present invention and its advantages are best understood by referring to FIGS. 1–4 of the drawings, like numerals being used for like and corresponding parts of the various drawings. The dimensions and clearances of FIGS. 1–4 are for purposes of illustration only and are not drawn to scale.

Figure 1:
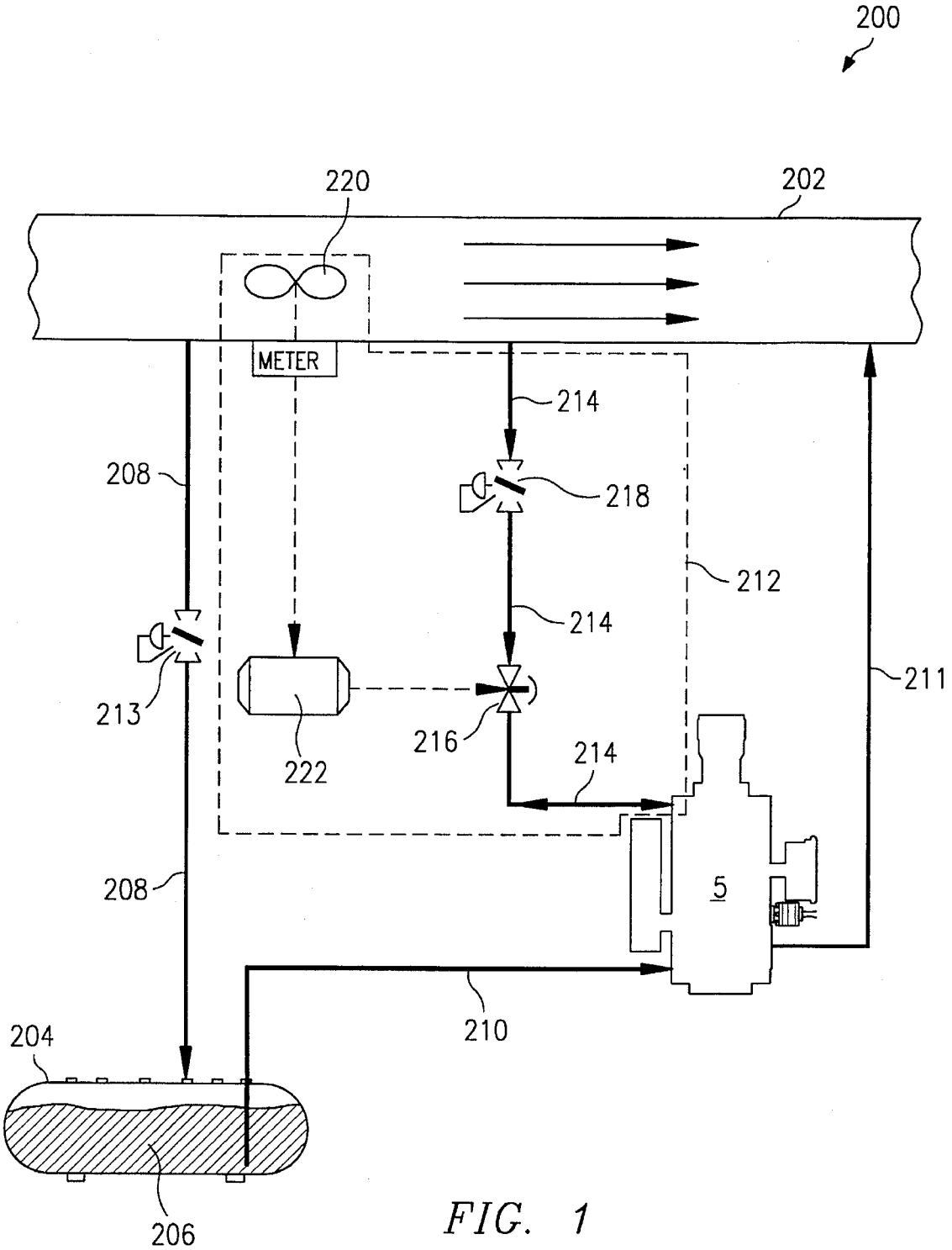
FIG. 1 is a schematic of an exemplary odorant injection system incorporating the preferred embodiment of the fluid pump of the present invention.

FIG. 1 illustrates the preferred embodiment of a fluid pump 5 incorporated into an exemplary odorant injection system 200 for injecting odorant into a natural gas pipeline 202. The exact design of odorant injection system 200 is not critical to the operation of the present invention, and therefore FIG. 1 generally shows a typical environment in which fluid pump 5 is utilized. Natural gas pipeline 202 contains natural gas that is typically pressurized up to 1000 psig and that flows in the direction illustrated by the arrows within gas pipeline 202. Gas pipeline 202 is occasionally pressurized up to 5000 psig, and one of ordinary skill in the art can easily adapt the odorant injection system described below to accommodate such higher pipeline pressures.

Viewed generally in a counterclockwise direction, odorant injection system 200 includes an odorant reservoir 204 that is filled with a liquid odorant 206. A conduit 208 fluidly connects gas pipeline 202 to odorant reservoir 204. A regulator 213, which is disposed on conduit 208, reduces the pressure in conduit 208 and thereby pressurizes liquid odorant 206 in reservoir 204 to the range of 15–30 psig. A conduit 210 fluidly connects odorant reservoir 204 with an inlet of fluid pump 5, and a conduit 211 fluidly connects an outlet of fluid pump 5 to gas pipeline 202.

Odorant injection system 200 further includes a cycling pneumatic source 212, which is composed of the components described below. A conduit 214 fluidly connects gas pipeline 202 to a power port of fluid pump 5. A three-way solenoid valve 216 and a regulator 218 are disposed on conduit 214. Regulator 218 reduces the pressure in conduit 214 to the range of 30–50 psig. A flow measuring device 220 measures the flow rate of the natural gas within gas pipeline 202 and provides this measurement to a flow control unit 222. Flow control unit 222 opens and closes solenoid valve 216 at a selected frequency responsive to the measured flow rate of gas pipeline 202 and the displacement of fluid pump 5. As is later described in greater detail, this cyclic opening and closing of solenoid valve 216 allows pneumatic source 212 to stroke fluid pump 5, and fluid pump 5 thus injects a precise volume of odorant into gas pipeline 202 via conduit 211 for each pump stroke.

Figure 2:
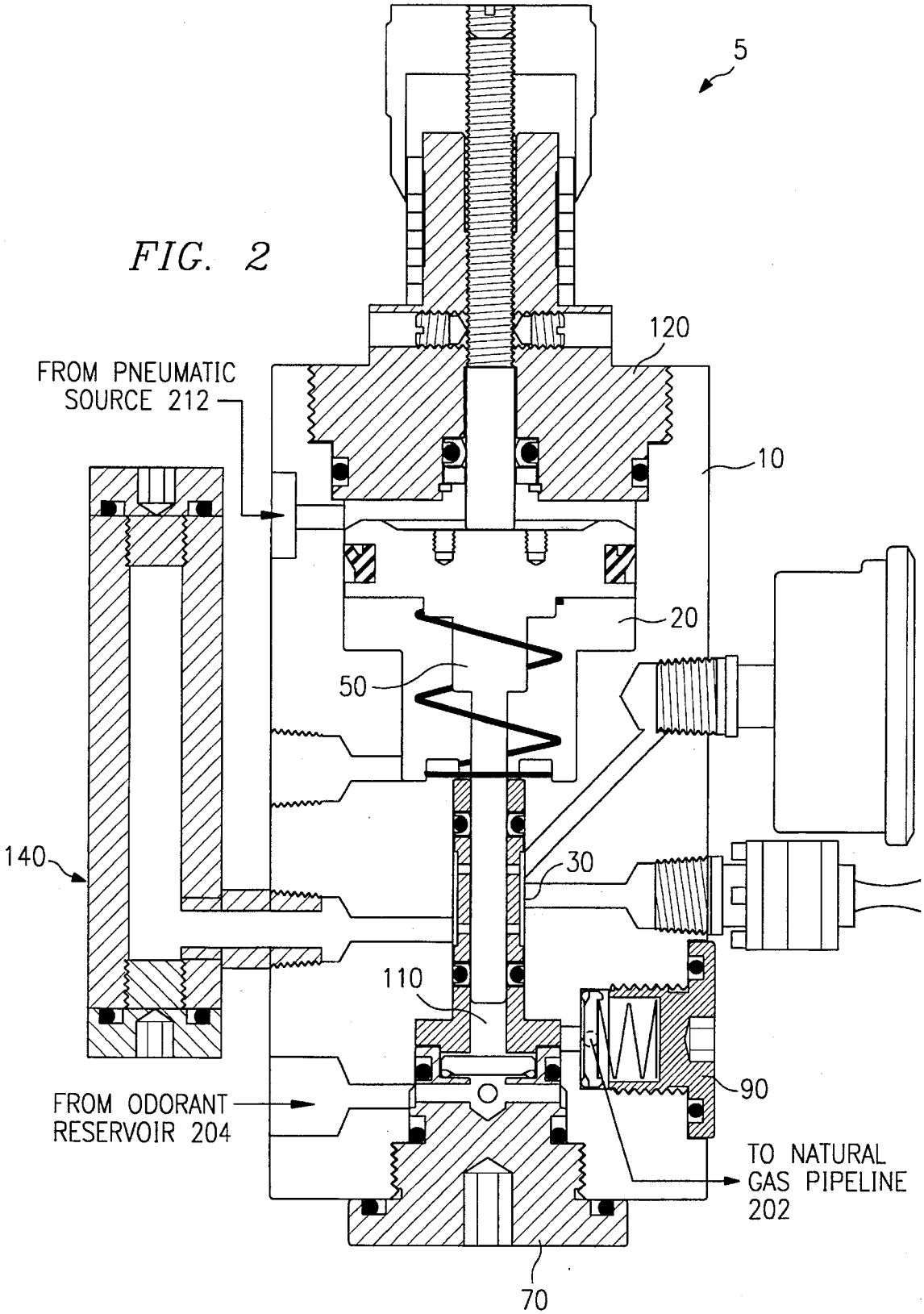
FIG. 2 is a cross-sectional view of the general subassemblies of the preferred embodiment of the fluid pump of the present invention.

Referring to FIG. 2, the preferred embodiment of fluid pump 5 and its general subassemblies are illustrated. Fluid pump 5 includes a housing 10 that is preferably made from stainless steel or aluminum and that preferably has a generally cylindrical geometry. Housing 10 preferably has a diameter of approximately 2.2 inches and a length of approximately 4.3 inches, although these dimensions of housing 10 are not critical to the operation of the present invention. Housing 10 has two interior chambers, an actuation chamber 20 and a cylindrical bore 30 connected to actuation chamber 20. A plunger assembly 50 is reciprocatively disposed in both actuation chamber 20 and cylindrical bore 30. A threaded inlet cartridge 70 screws into the bottom of housing 10, and a threaded discharge cartridge 90 screws into the outer surface of housing 10 at a point near inlet cartridge 70. Housing 10 also includes a pump chamber 110 which is an open volume generally defined by the location of one end of plunger assembly 50, inlet cartridge 70, discharge cartridge 90, and additional structure which is described in more detail below. A displacement adjustment assembly 120 screws into the top of housing 10 and adjusts the upstroke position of plunger assembly 50, as is later described in greater detail. Finally, housing 10 also includes a lubricating fluid reservoir assembly 140 in fluid connection with cylindrical bore 30.

Figure 3:
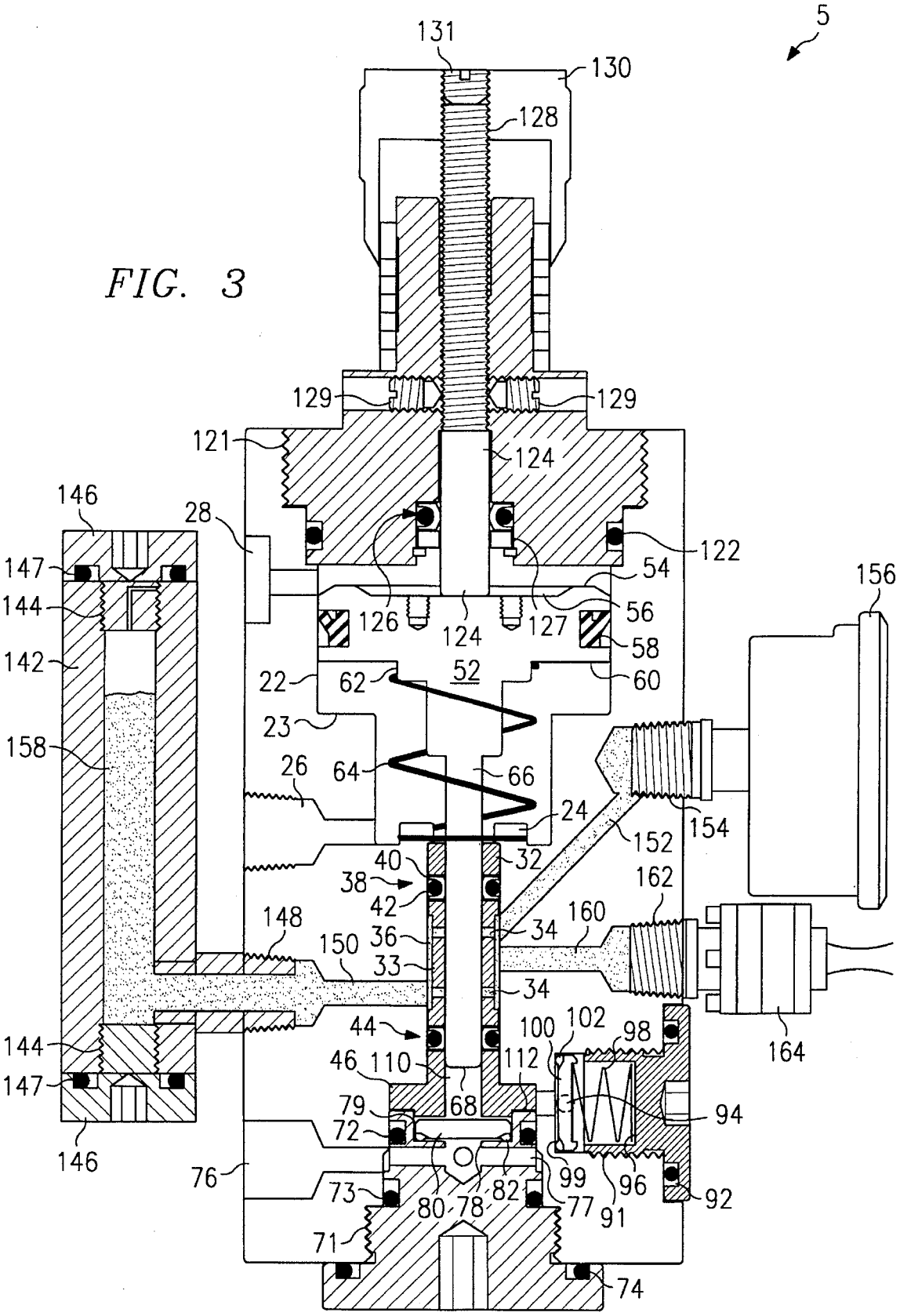
FIG. 3 is a detailed view of FIG. 2.

Before describing the preferred embodiment of fluid pump 5 in detail, a brief overview of the operation of fluid pump 5 is provided. As shown in FIGS. 1–3, conduit 210 supplies odorant from odorant reservoir 204 to pump chamber 110 of fluid pump 5 through inlet 76 (FIG. 3) and inlet cartridge 70. Cycling pneumatic source 212 repetitively strokes plunger assembly 50 to displace odorant from pump chamber 110 through outlet 94 (FIG. 3). Conduit 211, which is fluidly connected to outlet 94 and discharge cartridge 90, delivers the displaced odorant to gas pipeline 202.

Referring to FIGS. 2–3, the preferred embodiment of fluid pump 5 is described in greater detail. Actuation chamber 20 includes an annular piston retaining shelf 23 for limiting the downstroke of plunger assembly 50, as is later described in greater detail. An annular spring retention flange 24 is located at the top of cylindrical bore 30 at the point where cylindrical bore 30 connects with actuation chamber 20. An atmospheric port 26 connects one side of actuation chamber 20 to the atmosphere. A power port 28 fluidly connects the other side of actuation chamber 20 to pneumatic source 212.

Plunger assembly 50 includes an actuation piston 52 disposed in actuation chamber 20. Actuation piston 52 has a power surface 54 on its upper side and an atmospheric surface 60 on its lower side. Power surface 54 includes a concentric recessed area 56 for contacting displacement adjustment assembly 120. An annular piston seal 58 is located around the periphery of piston 52. Annular piston seal 58 fluidly seals actuation piston 52 to inner surface 22 of actuation chamber 20 and allows plunger assembly 50 to vertically reciprocate within actuation chamber 20 without the necessity of a lubricating fluid. Atmospheric surface 60 includes a concentric spring flange 62. A piston return spring 64 is disposed between spring flange 62 and annular spring retention flange 24 located at the top of cylindrical bore 30. A plunger 66 extends downward from spring flange 62, and the lower portion of plunger 66 is reciprocatively disposed within cylindrical bore 30, terminating in a plunger end 68.

A guide bushing 32 is disposed within cylindrical bore 30 beginning at the point where cylindrical bore 30 connects with actuation chamber 20. Guide bushing 32 preferably has an interior diameter substantially equal to the diameter of plunger 66 so that it guides plunger 66 during its reciprocation. A spacing member 33 is disposed within cylindrical bore 30 generally below guide bushing 32. Spacing member 33 has a hollow cylindrical geometry with an annular space 36 around its periphery. Spacing member 33 also has two pairs of opposing lubrication holes 34 bored from annular space 36 into the hollow interior of spacing member 33. The hollow interior of spacing member 33 preferably has a diameter slightly larger than the diameter of plunger 66. Guide bushing 32 and spacing member 33 are preferably made from a synthetic fluorine-containing resin sold under the trademark "TEFLON" and thus provide a low-friction surface surrounding plunger 66 during its reciprocation within cylindrical bore 30.

An upper plunger seal 38, disposed within cylindrical bore 30 between guide bushing 32 and spacing member 33, fluidly seals actuation chamber 20 from cylindrical bore 30. Upper plunger seal 38 has a C-shaped cross-sectional member 40 and a rubber O-ring 42 which is compressively disposed within C-shaped member 40. O-ring 42 provides a fluid seal against the inner surface of cylindrical bore 30. C-shaped member 40, which is preferably made from "TEFLON", provides a fluid seal against plunger 66 and a low-friction surface against which plunger 66 reciprocates. A preferred seal for upper plunger seal 38 is a seal sold by Micro Dot, Inc. under the trademark "CROWN SEAL". A lower plunger seal 44, preferably identical to upper plunger seal 38, fluidly seals the portion of cylindrical bore 30 above seal 44 from communicating with pump chamber 110 below seal 44.

An inlet bushing 46 is captured between housing 10 and inlet cartridge 70. Inlet bushing 46 serves three functions. First, it is preferably made from "TEFLON" and serves as a low-friction guide for plunger 66, similar to guide bushing 32. Second, it supports lower plunger seal 44, spacing member 33, upper plunger seal 38, and guide bushing 32 within cylindrical bore 30, so that these parts can be easily removed for maintenance when inlet cartridge 70 is unscrewed from housing 10. Third, it increases the volumetric efficiency of pump chamber 110, as is later described in more detail.

Threaded inlet cartridge 70 is removably disposed within the bottom of housing 10 by a threads 71. An upper inlet seal 72 located on the periphery of inlet cartridge 70 near pump chamber 110 fluidly seals inlet cartridge 70 to housing 10. Similarly, a middle inlet seal 73 and a lower inlet seal 74, which are located on the periphery of inlet cartridge 70 on either side of threads 71, also fluidly seal inlet cartridge 70 to housing 10. Any conventional fluid seal, such as a rubber O-ring, can be utilized for inlet seals 72, 73, and 74. Inlet 76 of housing 10 is fluidly connected to a hole 77 bored into inlet cartridge 70 just below annular inlet valve shelf 78. An inlet check valve 80 is movably disposed between annular inlet valve shelf 78 and inlet bushing 46. Inlet check valve 80 is preferably made from stainless steel and includes an elastomer sealing ring 82 on its lower surface.

Threaded discharge cartridge 90 is removably disposed within housing 10 by threaded end 91. Outlet seal 92 located on the periphery of discharge cartridge 90 near the outer surface of housing 10 fluidly seals discharge cartridge 90 to housing 10. Outlet seal 92 can be any conventional fluid seal such as a rubber O-ring. An outlet 94 is bored through housing 10 within discharge cartridge 90. An outlet valve return spring 98 is disposed on an annular outlet valve shelf 96. An outlet check valve 100 is movably disposed between an inner surface 99 of housing 10 and outlet valve return spring 98. Similar to inlet check valve 80, outlet check valve 100 is preferably made from stainless steel and has an elastomer sealing ring 102 disposed on its surface nearest inner surface 99. Discharge cartridge 90 is easily unscrewed from housing 10 for maintenance on outlet valve return spring 98 or outlet check valve 100.

Lower plunger seal 44, inlet bushing 46, inlet cartridge 70, inlet check valve 80, discharge cartridge 90, outlet check valve 100, and plunger end 68 define pump chamber 110. An outlet conduit 112 within pump chamber 110 leads to outlet 94. All of the above components defining pump chamber 110 are manufactured with very tight tolerances, preferably in the range of ±0.002 inches. In addition, inlet check valve 80 and outlet check valve 100 are specifically designed to operate with very small clearances. For example, the clearance between the upper surface of inlet check valve 80 and the lower surface of inlet bushing 46 is preferably 0.010 inches. As another example, the clearance between the periphery of inlet check valve 80 and surface 79 of discharge cartridge 70 is preferably 0.005 inches.

Threaded displacement adjustment assembly 120 is removably disposed within the top of housing 10 by threads 121. An outer displacement seal 122 located on the periphery of displacement adjustment assembly 120 near actuation chamber 20 fluidly seals displacement adjustment assembly 120 to housing 10. Outer displacement seal 122 can be any conventional fluid seal such as a rubber O-ring. An adjustable rod 124 extends from displacement adjustment assembly 120 into actuation chamber 20. Adjustable rod 124 contacts recessed area 56 of actuation piston 52 when plunger assembly 50 is in an upstroke position as shown in FIGS. 2–3. An inner displacement seal 126 located on an inner surface 127 of displacement adjustment assembly 120 fluidly seals adjustable rod 124 to displacement adjustment assembly 120. Inner displacement seal 126 is preferably similar in construction to upper plunger seal 38 and lower plunger seal 44. Adjustable rod 124 is connected to a micrometer screw 128 disposed within displacement adjustment assembly 120. Micrometer screw 128 is supported within displacement adjustment assembly 120 by "TEFLON"-tip set screws 129 and jam nut 131. Micrometer screw 128 is actuated by turning a knurled nut 130 located on the exterior of displacement adjustment assembly 120. Displacement adjustment assembly 120 is easily removed from housing 10 for maintenance on plunger assembly 50.

Lubricating fluid reservoir assembly 140 is removably disposed on the outer surface of housing 10. Fluid reservoir assembly 140 includes a reservoir 142 having opposing threaded ends 144. Removable threaded caps 146 are received within threaded ends 144, and cap seals 147 fluidly seal threaded caps 146 to reservoir 142. Cap seals 147 can be any conventional fluid seal such as a rubber O-ring. Reservoir 142 also has a threaded end 148 that is received within housing 10 to secure reservoir 142 to housing 10. A conduit 150 fluidly connects reservoir 142 to annular space 36 around the periphery of spacing member 33. A conduit 152 fluidly connects annular space 36 to a pressure port 154. A pressure gauge 156, which is mounted externally to housing 10, is connected to pressure port 154. A conduit 160 fluidly connects annular space 36 to a pressure port 162. A pressure transducer 164, which is mounted externally to housing 10, is connected to pressure port 162. A lubricating fluid 158, preferably a low viscosity, temperature stable fluid, fills reservoir 142, conduit 150, annular space 36, lubrication holes 34, the volume between plunger 66 and the hollow interior of spacing member 33, conduit 152, and conduit 160. For reasons explained below, fluid reservoir assembly 140, conduit 150, annular space 36, lubrication holes 34, cylindrical bore 30, upper plunger seal 38, lower plunger seal 44, conduit 152, and conduit 160 define a closed system.

The operation of the preferred embodiment of the present invention is now described with reference to FIGS. 1–4. This description first details how odorant is supplied to pump chamber 110 for each pump stroke, and then discusses how fluid pump 5 discharges odorant from pump chamber 110 into gas pipeline 202 for each pump stroke.

Figure 4:
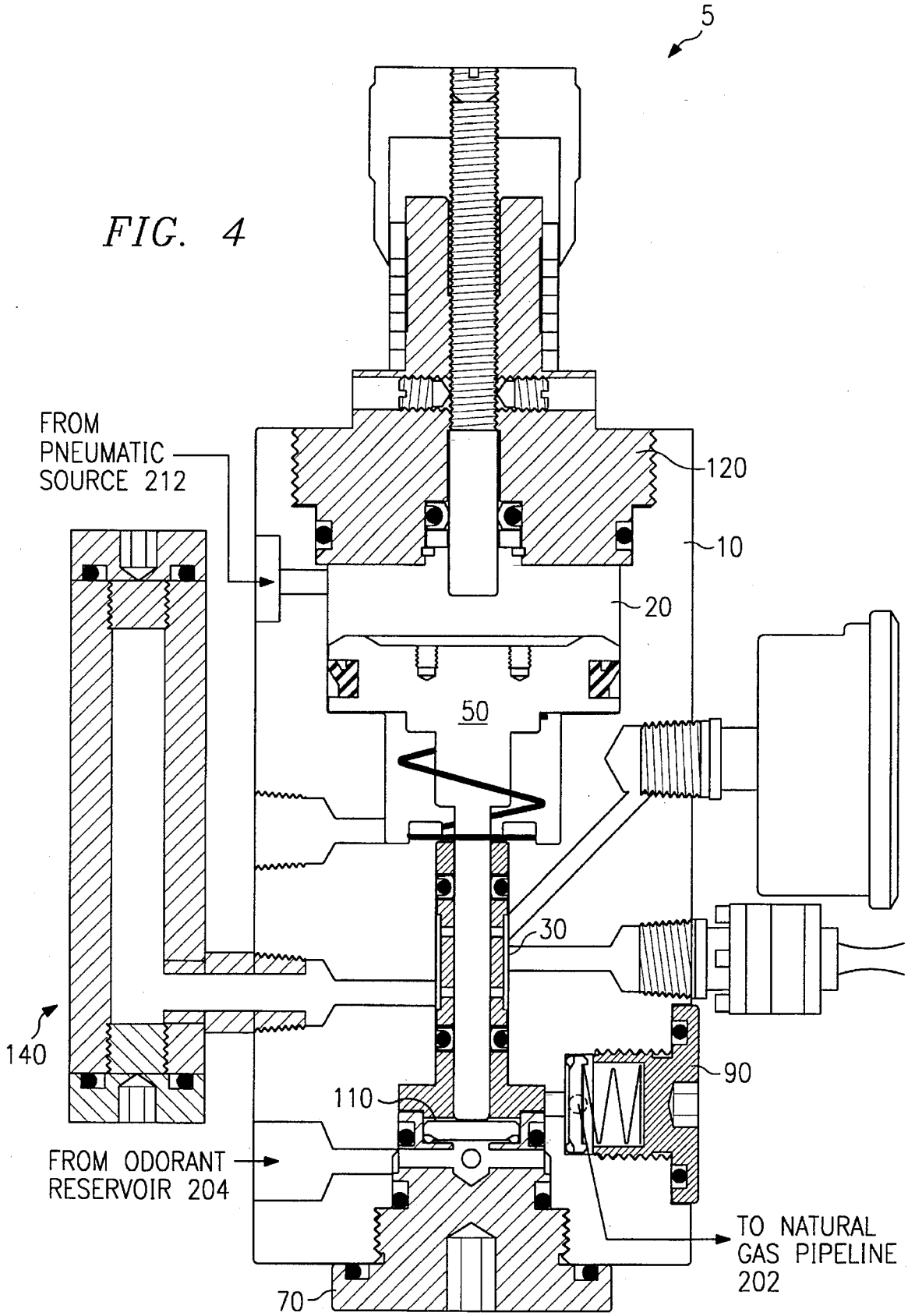
FIG. 4 is a cross-sectional view of the preferred embodiment of the fluid pump of the present invention shown in the full downstroke position.

As plunger assembly 50 moves from a downstroke position, as shown in FIG. 4, to an upstroke position, as shown in FIGS. 2–3, pressurized odorant from inlet 76 moves inlet check valve 80 upward so that elastomer sealing ring 82 no longer contacts annular inlet valve shelf 78. Odorant thus flows into pump chamber 110 until pump chamber 110 is entirely filled. The pressurized odorant within pump chamber 110 does not overcome the opposing pressure exerted on outlet check valve 100 by outlet valve return spring 98 and natural gas pipeline 202.

As mentioned previously, the pressurized odorant supplied to pump chamber 110 is a liquid containing dissolved gas. Gas typically becomes dissolved within the liquid odorant in two ways. First, as explained in connection with FIG. 1, natural gas is used to pressurize odorant reservoir 204 so that odorant moves from reservoir 204 to fluid pump 5 through conduit 210. Second, odorant injection systems in the field are often subjected to high summer temperatures. An increase in temperature, or a loss in pressure, can cause the odorant to partially vaporize.

Referring to FIGS. 1–4, when flow control unit 222 opens solenoid valve 216, pressurized gas flows through conduit 214 to power port 28 and into actuation chamber 20 above power surface 54 of actuation piston 52. The pressurized gas overcomes the resistance of piston return spring 64 and the pressurized odorant within pump chamber 110, and plunger assembly 50 moves from an upstroke position, as shown in FIGS. 2–3, to a downstroke position, as shown in FIG. 4. As plunger assembly 50 begins its downstroke, elastomer sealing ring 82 of inlet check valve 80 once again seals on annular inlet valve shelf 78. The downstroke position of plunger assembly 50 is defined by the abutment of atmospheric surface 60 of actuation piston 52 against annular piston retaining shelf 23.

As plunger assembly 50 progresses through its downstroke, plunger 66 slides downward within inlet bushing 46 to decrease the volume of pump chamber 110. At its full downstroke position, as shown in FIG. 4, plunger end 68 preferably contacts inlet check valve 80. In order to displace both the liquid odorant and any gas within pump chamber 110, the volumetric efficiency of pump chamber 110 must be high enough to overcome the compressibility factor of natural gas and to displace gas even if pump chamber 110 is completely filled with accumulated gas. With such an efficiency, fluid is continually drawn into pump chamber 110 through conduit 210 and eventually replaces the accumulated gas with liquid. For these reasons, the volumetric efficiency of pump chamber 110 is preferably at least about 80 percent at a displacement of 0.1 cc for each stroke of plunger assembly 50. In addition, it is contemplated that pump chamber 110 may obtain a volumetric efficiency of up to about 95 percent at a displacement of 0.1 cc for each stroke of plunger assembly 50. Note that in the preferred embodiment, the volumetric efficiency of pump chamber 110 is most easily increased by employing a specific geometry and size of inlet bushing 46.

As plunger assembly 50 begins to reach its downstroke position, as shown in FIG. 4, liquid odorant and dissolved gas is ejected through outlet 94. More specifically, the ratio of the cross-sectional area of actuation piston 52 to the cross-sectional area of plunger end 68 is preferably a 50:1 ratio. Therefore, the 30–50 psig pressurized gas supplied by pneumatic source 212 acting on actuation piston 52 results in plunger end 68 exerting a 1500–2500 psig pressure in pump chamber 110 at full downstroke. This 1500–2500 psig pressure overcomes the opposing pressure exerted on outlet check valve 100 by outlet valve return spring 98 and natural gas pipeline 202. Elastomer sealing ring 102 is thus displaced to the right away from its sealing point on inner surface 99 of housing 10, and the odorant within pump chamber 110 is displaced through outlet conduit 112, through outlet 94, through conduit 211, and into natural gas pipeline 202. As flow control unit 222 switches solenoid valve 216 to cycle off pneumatic source 212, the pressure in pump chamber 110 decreases, and outlet valve return spring 98 reseals elastomer sealing ring 102 on inner surface 99 of housing 10. Simultaneously, piston return spring 64 moves plunger assembly 50 toward its upstroke position, and solenoid valve 216 bleeds the pressurized gas used to stroke plunger assembly 50 to the atmosphere. The stroke of plunger assembly 50 is then complete.

The preferred embodiment also provides for the adjustment of the precise volume of odorant displaced by each stroke of plunger assembly 50 to any selected amount in the range of 0.02 cc to 0.1 cc. Referring to FIG. 3, the vertical position of adjustable rod 124 within actuation chamber 20 is adjusted by rotating knurled knob 130 to turn micrometer screw 128. Adjustable rod 124 contacts recessed area 56 of actuation piston 52 to limit the upstroke position of plunger assembly 50. Therefore, if adjustable rod 124 is adjusted to extend farther into actuation chamber 120, the stroke of plunger assembly 50, the volume of pump chamber 110, and thus the volume of odorant displaced from pump chamber 110 are decreased. Conversely, if adjustable rod 124 is adjusted to retract from actuation chamber 120, the stroke of plunger assembly 50, the volume of pump chamber 110, and thus the volume of odorant displaced from pump chamber 110 are increased. Although micrometer screw 128 allows for the volume displaced to be adjusted to any selected amount in the range of 0.02 cc to 0.1 cc per stroke, displacement adjustment assembly 120 cannot adjust the upstroke position of plunger assembly 50 so that plunger end 68 travels above lower plunger seal 44.

Lubricating fluid 158 lubricates plunger 66, upper plunger seal 38, and lower plunger seal 44 during reciprocation of plunger assembly 50. Lubricating fluid 158 completely surrounds plunger 66 within spacing member 33 between lower plunger seal 44 and upper plunger seal 38.

During operation of fluid pump 5, lower plunger seal 44 is repetitively subjected to the pressure differential between the pressure of the odorant in pump chamber 110 at full upstroke position and the pressure of odorant in pump chamber 110 at full downstroke position. This repetitive pressure cycling, combined with the drying effect of the liquid odorant within pump chamber 110 on lower plunger seal 44, typically results in the eventual failure of seal 44 after a lengthy time of service. If the anticipated, eventual failure of lower plunger seal 44 occurs, the odorant within pump chamber 110 commingles with lubricating fluid 158 within reservoir 142, conduit 150, conduit 152, conduit 160, annular space 36, and lubrication holes 34. In addition, because the volume of pump chamber 110 is thereby increased by the volumes of reservoir 142, conduit 150, conduit 152, conduit 160, annular space 36, and lubrication holes 34, while the stroke or displacement of plunger assembly 50 remains constant, the volumetric efficiency of pump chamber 110 greatly decreases, and the possibility of vapor locking correspondingly increases. Furthermore, this anticipated, eventual failure results in an imprecise, undetermined amount of odorant being displaced into natural gas pipeline 202, due to both a commingling of odorant with lubricating fluid 158 as well as a significant percentage of the dissolved gas within the odorant being compressed but not displaced from pump chamber 110 with each stroke of plunger 66. Thus, if the anticipated, eventual failure of lower plunger seal 44 occurs and remains uncorrected, natural gas supply 202 will not be properly odorized.

In addition to the effect of a failure of lower plunger seal 44 on the proper odorization of gas pipeline 202, such failure also affects the proper lubrication of fluid pump 5. Particularly, once lower plunger seal 44 fails, lubricating fluid 158 is displaced from fluid pump 5 along with odorant. Therefore, fluid pump 5 will eventually fail due to lack of lubrication to upper plunger seal 38. In existing dual seal pumps, these dangers are compounded because such pumps appear to be working normally from an external perspective despite a failure of a lower plunger seal.

Given the problems described above, the preferred embodiment immediately and reliably indicates a failure of lower plunger seal 44 and thus addresses an important safety need of the natural gas distribution industry. As described previously, fluid reservoir assembly 140, conduit 150, annular space 36, lubrication holes 34, cylindrical bore 30, upper plunger seal 38, lower plunger seal 44, conduit 152, and conduit 160 define a closed system under normal operating conditions of fluid pump 5. This closed system is filled with lubricating fluid 158, and pressure gage 156 and pressure transducer 164 have low, generally constant readings under normal conditions. For example, and not by way of limitation, the readings of pressure gage 156 and pressure transducer 164 may be in the range of 0–10 psig under normal operating conditions. However, if lower plunger seal 44 fails, the pressure within pump chamber 110 is communicated upward beyond seal 44 into the closed system described above. Therefore, the readings on pressure gage 156 and pressure transducer 164 alternate approximately between the pressure of the odorant in pump chamber 110 at full upstroke position (e.g. 15–30 psig) and the pressure of the odorant in pump chamber 110 at full downstroke position (e.g. 1500–2500 psig), responsive to the reciprocation of plunger assembly 50. In this manner, a failure of lower plunger seal 44 is easily detected by inspecting pressure gage 156 locally or by monitoring the signal of pressure transducer 164 remotely. In existing dual seal pumps, however, a lower plunger seal failure will most likely remain undetected and uncorrected until the upper seal fails, odorant is released to the atmosphere, and a total pump failure occurs. This feature of the present invention thus greatly increases the safety of fluid pump 5 used as an odorant injection pump.

From the above, it may be appreciated that the preferred embodiment of the present invention provides a fluid pump that displaces a small, precise, and adjustable volume of a liquid containing dissolved gas for each stroke of the pump. The preferred embodiment also indicates a failure of the lower seal of the dual plunger seal design of the fluid pump, thus improving the safety realized by the preferred embodiment when it is employed to inject odorant into a natural gas pipeline. The indication of a lower seal failure by the preferred embodiment allows maintenance personnel to repair the pump before the upper seal fails, odorant is released to the atmosphere, and a total pump failure occurs. In addition, the preferred embodiment of the present invention also provides a fluid pump that has modular components that are easily removable for service, testing, or replacement.

Note that the invention is illustrated herein by example, and various modifications may be made by a person of ordinary skill in the art. For example, although the preferred embodiment refers to a fluid pump for injecting odorant into a natural gas pipeline, the present invention is likely to be useful in any application in which a small, precision volume of fluid or chemical injection is required. As another example, although the preferred embodiment utilizes a cycling pneumatic source to reciprocate the plunger assembly of the fluid pump, alternative cycling power sources, including liquid or electro-mechanical sources, might be utilized to provide such reciprocation. As another example, the pump chamber of the present invention could be manufactured to a selected volume with very tight tolerances so as to increase the volumetric efficiency of the pump chamber instead of employing the inlet bushing of the preferred embodiment to accomplish the same function. As a final example, numerous dimensions and/or geometries could be altered to accommodate a given configuration. Consequently, while the present invention has been described in detail, various substitutions, modifications, or alterations could be made to the description set forth above without departing from the invention which is defined by the following claims.

What is claimed is:

1. A fluid pump for pumping a liquid containing dissolved gas, comprising:

a housing having an interior bore, said interior bore having first and second ends, an inlet proximate said second end of said interior bore, and an outlet proximate said second end of said interior bore;

an inlet valve for allowing a fluid to flow only into said interior bore through said inlet, said fluid comprising a liquid containing dissolved gas;

an outlet valve for allowing said fluid to flow only from said interior bore through said outlet;

an inlet bushing disposed within said interior bore proximate said inlet;

a plunger assembly reciprocatively disposed within said interior bore, said plunger assembly having a first end reciprocatively disposed within said inlet bushing;

a first annular seal disposed on said inlet bushing for fluidly sealing said plunger assembly to said interior bore;

a pump chamber defined by said interior bore, said first annular seal, said inlet bushing, said inlet valve, said outlet valve, and said first end of said plunger assembly, said pump chamber having a volumetric efficiency sufficient to displace gas from said pump chamber;

a hollow spacing member disposed on said first annular seal;

a second annular seal disposed on said spacing member for fluidly sealing said plunger assembly to said interior bore;

a closed lubricating fluid reservoir in fluid connection with said interior bore between said first annular seal and said second annular seal;

a lubricating fluid within said lubricating fluid reservoir; and pressure indicating means fluidly connected to said lubricating fluid reservoir;

wherein said first end of said plunger assembly is for reciprocating to displace a precise volume of said fluid from said pump chamber through said outlet; and wherein a failure of said first annular seal is indicated on said pressure indicating means by a pressure differential responsive to said reciprocation of said plunger assembly.

2. The fluid pump of claim 1 wherein said pressure indicating means comprises a pressure gage.

3. The fluid pump of claim 1 wherein said pressure indicating means comprises a pressure transducer.

4. The fluid pump of claim 1 wherein said pressure indicating means comprises a pressure gage and a pressure transducer.

5. The fluid pump of claim 1 and further comprising means connected to said housing for adjusting said precise volume of fluid displaced to a selected amount in the range of 0.02 cc to 0.1 cc for each reciprocation of said plunger assembly.

6. The fluid pump of claim 5 wherein said plunger assembly comprises a second end proximate said first end of said interior bore, said second end of said plunger assembly having a first surface and an opposing second surface;

wherein said interior bore comprises:

a port proximate said first end of said interior bore for fluidly connecting with a cycling pneumatic source for imparting a downstroke to said first surface of said second end of said plunger assembly; and an annular shelf for contacting said second surface of said second end of said plunger assembly to limit said downstroke; and further comprising a return spring disposed between said second surface of said second end of said plunger assembly and a surface of said interior bore for returning said plunger assembly to an upstroke position when said pneumatic source is cycled off.

7. The fluid pump of claim 6 wherein said adjusting means comprises a precision linearly adjustable rod for contacting said first surface of said second end of said plunger assembly, said adjustable rod being moveable to selected positions to adjust said upstroke position of said plunger assembly.

8. A fluid pump, comprising:

a housing having a pump chamber and a second chamber, said second chamber comprising a closed system filled with a lubricating fluid;

a fluid seal disposed between said pump chamber and said second chamber;

reciprocating means disposed within said pump chamber for displacing a fluid from said pump chamber; and a pressure indicating means fluidly connected to said second chamber;

wherein a failure of said fluid seal is indicated on said pressure indicating means by a pressure differential responsive to a displacement of said reciprocating means.

9. The fluid pump of claim 8 wherein said pressure indicating means comprises a pressure gage.

10. The fluid pump of claim 8 wherein said pressure indicating means comprises a pressure transducer.

11. The fluid pump of claim 8 wherein said pressure indicating means comprises a pressure gage and a pressure transducer.

12. The fluid pump of claim 8 wherein said lubricating fluid lubricates said reciprocating means and said fluid seal.

13. An odorant injection system for injecting a liquid odorant containing dissolved gas into a natural gas pipeline, comprising:

an odorant reservoir containing liquid odorant with dissolved gas;

a fluid pump, comprising:

a housing having an interior bore, structure defining a pump chamber within said interior bore, and a power port, said pump chamber having an inlet in fluid connection with said odorant reservoir, an outlet for fluidly connecting with said natural gas pipeline, and a volumetric efficiency sufficient to displace gas from said pump chamber;

an inlet valve allowing said odorant to flow only into said pump chamber through said inlet;

an outlet valve allowing said odorant to flow only from said pump chamber through said outlet; and reciprocating means disposed within said interior bore and said pump chamber for displacing a precise volume of said fluid through said outlet;

a cycling pneumatic source for displacing said reciprocating means, comprising:

a conduit fluidly connecting said natural gas pipeline to said power port;

a pressure regulator disposed on said conduit between said pipeline and said power port;

a solenoid valve disposed on said conduit between said regulator and said power port; and a control unit for opening and closing said solenoid valve responsive to a flow rate of natural gas within said pipeline and a displacement of said fluid pump.

14. The odorant injection system of claim 13 wherein said fluid pump further comprises:

structure defining a second chamber within said interior bore, said second chamber comprising a closed system filled with a lubricating fluid;

a fluid seal disposed between said pump chamber and said second chamber; and a pressure indicating means fluidly connected to said second chamber;

wherein a failure of said fluid seal is indicated on said pressure indicating means by a pressure differential responsive to a displacement of said reciprocating means.

* * * * *

UNITED STATES PATENT AND TRADEMARK OFFICE

CERTIFICATE OF CORRECTION

PATENT NO. : 5,490,766

DATED : February 13, 1996

INVENTOR(S) : Mark V. Zeck

It is certified that error appears in the above-indentified patent and that said Letters Patent is hereby corrected as shown below:

Col 3, ln. 65, delete "INVENTION", insert --DRAWINGS--.

Signed and Sealed this

Sixth Day of August, 1996

*Attest:*

Bruce Lehman

BRUCE LEHMAN

*Attesting Officer*

*Commissioner of Patents and Trademarks*